US008277188B2

(12) United States Patent
Belmonte

(10) Patent No.: US 8,277,188 B2
(45) Date of Patent: Oct. 2, 2012

(54) TURBOMACHINE ROTOR DISK

(75) Inventor: Olivier Belmonte, Savigny le Temple (FR)

(73) Assignee: SNECMA, Paris (FR)

( * ) Notice: Subject to any disclaimer, the term of this patent is extended or adjusted under 35 U.S.C. 154(b) by 1237 days.

(21) Appl. No.: 12/048,726

(22) Filed: Mar. 14, 2008

(65) Prior Publication Data

US 2008/0226457 A1 Sep. 18, 2008

(30) Foreign Application Priority Data

Mar. 16, 2007 (FR) ..... 07 01906

(51) Int. Cl.
*F01D 5/30* (2006.01)

(52) U.S. Cl. ..... 416/193 R; 416/248; 416/219 R

(58) Field of Classification Search ..... 416/219 R, 416/220 R, 248, 221, 204 A, 193 A, 193 R, 416/186 R, 185
See application file for complete search history.

(56) References Cited

U.S. PATENT DOCUMENTS

| | | | | |
|---|---|---|---|---|
| 3,096,074 | A * | 7/1963 | Pratt et al. | 416/215 |
| 3,640,640 | A | 2/1972 | Palfreyman et al. | |
| 3,801,222 | A * | 4/1974 | Violette | 416/220 R |
| 5,240,375 | A * | 8/1993 | Wayte | 416/219 R |
| 6,290,466 | B1 * | 9/2001 | Ravenhall et al. | 416/229 A |
| 6,431,835 | B1 * | 8/2002 | Kolodziej et al. | 416/219 R |
| 6,832,896 | B1 * | 12/2004 | Goga et al. | 416/191 |
| 6,860,722 | B2 * | 3/2005 | Forrester et al. | 416/219 R |
| 7,284,958 | B2 * | 10/2007 | Dundas et al. | 416/193 A |
| 2008/0226457 | A1 * | 9/2008 | Belmonte | 416/219 R |

FOREIGN PATENT DOCUMENTS

| | | |
|---|---|---|
| EP | 1 085 172 A2 | 3/2001 |
| EP | 1 306 523 A1 | 5/2003 |
| FR | 2 608 674 | 6/1988 |
| GB | 2 064 667 A | 6/1981 |

OTHER PUBLICATIONS

U.S. Appl. No. 12/035,916, filed Feb. 22, 2008, Belmonte, et al.
U.S. Appl. No. 12/038,864, filed Feb. 28, 2008, Belmonte, et al.

* cited by examiner

*Primary Examiner* — Edward Look
*Assistant Examiner* — Christopher R Legendre
(74) *Attorney, Agent, or Firm* — Oblon, Spivak, McClelland, Maier & Neustadt, L.L.P.

(57) ABSTRACT

A turbomachine rotor disk including inter-blade platforms fixed to ribs delimited by cavities in which blade roots are retained, and protective liners mounted between the flanks of the cavities of the disk and the blade roots is disclosed. The protective liners have a C-shaped cross section so that they can be fitted translationally and retained radially on the ribs of the disk and constitute a locking device which locks the platforms on the ribs of the disk.

11 Claims, 3 Drawing Sheets

TURBOMACHINE ROTOR DISK

BACKGROUND OF THE INVENTION AND DESCRIPTION OF THE PRIOR ART

The present invention relates to a fan rotor disk of a turbomachine such as an airplane turbojet engine.

In the known art, a rotor disk is formed at its periphery with an alternation of cavities and of ribs and bears a plurality of blades each formed of an airfoil section connected to a root engaged axially and retained radially in a cavity belonging to the disk. Platforms are fixed between the blades by radial flanges connected to corresponding radial flanges formed on the ribs of the disk.

The dynamics involved in mounting and removing the platforms onto and off the ribs of the disk entails that the platform perform a translational movement along the rib so that orifices in the flanges of the platform engage with pegs or rods provided on the flanges of the disk.

In a turbomachine, the lateral edges of the platforms have to be close enough to the blade airfoil sections to prevent parasitic flow of air toward the disk. The airfoil sections of a fan have a curved profile which means that the lateral edges of the platforms have also to be curved. However, because of the fitting and removal dynamics, there needs to be some clearance between the edges of the platforms and the airfoil sections and this gives rise to air leaks toward the disk. This clearance is particularly large at the axial ends of the platform. Thus, the buildup of blade/platform clearances over the entire disk leads to a reduction in the overall efficiency of the turbomachine.

In the prior art, solutions were focused on restoring the seal between the platform and the blade. However, techniques such as this entail the incorporation of additional components, making the turbomachines heavier.

SUMMARY OF THE INVENTION

It is a particular objective of the invention to provide a simple, economical and effective solution to these various problems.

To this end, the invention proposes a turbomachine fan rotor disk comprising, at its periphery, blades the roots of which are retained in cavities of the disk, and inter-blade platforms fixed to ribs delimited by the cavities in which the blade roots are mounted, protective liners being mounted between the flanks of the cavities of the disk and the blade roots, wherein the protective liners have a C-shaped cross section so that they can be fitted translationally and retained radially on the ribs of the disk and form means of locking the platforms onto the ribs of the disk.

In the known art, the liners are used to protect the blade roots against friction on the internal walls of the cavity. The liner is usually made of a material that has greater resistance to wear than the blade root and than the disk.

According to the invention, the liners perform an additional function by radially retaining the intern-blade platforms in position on the ribs of the rotor disk using locking means. The invention therefore makes it possible to reduce the clearance between the blade and the platform because the platform no longer needs to be inserted axially, locking being afforded by the liners. The lateral edges of the platform can thus perfectly correspond to the curvature of the blade airfoil section.

According to another feature of the invention, the platforms on the disk comprise roots pressed against the ribs of the disk, these roots being engaged and retained in cutouts or openings in the liners.

In a preferred embodiment, the liners can be moved translationally on the ribs between a position in which they free and a position in which they retain the roots of the platforms and are immobilized in their retaining position by an annular component mounted on the upstream face of the disk for axially retaining the blade roots in the cavities of the disk.

This system of locking using a translational movement of the protective liner allows the platform to be mounted on a rib of the disk with a minimum of clearance.

According to another feature of the invention, the roots of the platforms comprise radial uprights and axial rims extending in the upstream direction from the radial uprights. When the protective liner is in the locked position, the axial rims lie inside the protective liner and can thus be used to hold the platform in position on the rib of the disk.

Advantageously, the cavities and ribs of the disk and the protective liners have a helicoidal profile.

In certain turbomachine configurations, the rotor blade roots are mounted in cavities of the disk that make an angle with the axis of the disk. Thus, when the blades are mounted in the cavities of the disk, there are unequal thicknesses of rib radially retaining the blades on each side of the blade root and this can give rise to premature blade root wear. The use of helicoidal profiles for the cavities and ribs of the disk makes it possible to keep constant thicknesses on each side of the blade roots over the entire length of the disk, the liners having a helicoidal profile so that they can be fitted onto the ribs.

The platforms are advantageously mounted on the disk by radial translation.

The invention also relates to a turbomachine such as an airplane turbojet engine and which comprises a disk of the type described hereinabove.

The invention further relates to a protective liner for a blade root in a turbomachine and which has a C-shaped cross section and comprises cutouts or openings formed in its wall connecting the legs of the C. The protective liner may have a helicoidal profile.

BRIEF DESCRIPTION OF THE DRAWINGS

Other advantages and features of the invention will become apparent from reading the following description which is given by way of nonlimiting example and with reference to the attached drawings in which.

DESCRIPTION OF THE PREFERRED EMBODIMENT

Figure 1:
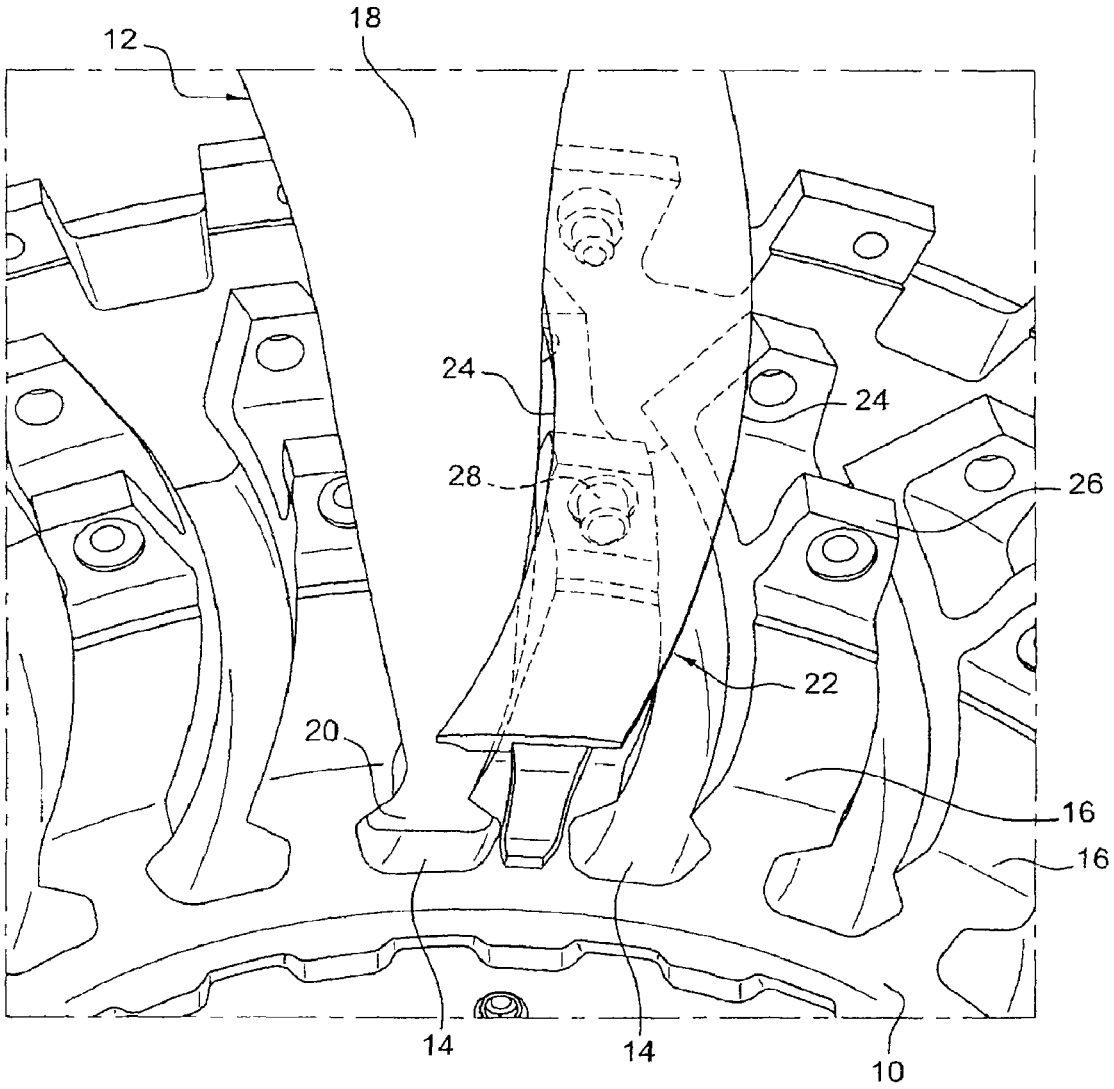
Fig. 1 PRIOR ART
FIG. 1 is a partial perspective view of a disk bearing a blade and a platform according to the prior art.

Reference is made first of all to FIG. 1 which depicts part of a turbomachine disk 10 bearing a blade 12 according to the prior art. The disk 10 at its periphery comprises an alternation of cavities 14 and of ribs 16 extending longitudinally over the entire length of the disk 10. The rotor blade 12 formed of an airfoil section 18 connected to a blade root 20 is engaged and retained radially in a cavity 14 of the disk 10. A platform 22 is positioned on a rib 16 of the disk 10, the edges 24 of the platform 22 being positioned close enough to the airfoil section 18 of the contiguous blade 12 that flows of air toward the disk 10 are prevented. The platform 22 is fixed by inwardlyextending radial flanges onto outwardly extending radial flanges 26 of a rib 16 of the disk 10. Rods 28 inserted in the flanges 26 of the disk 10 and the flanges of the platform 22 radially retain the platform 22 on the rib 16. The dynamics of fitting and removing the platform 22 dictate that the flanges being gauged onto the rods 28 through a platform 22 movement along the central axis of the rib 16. Now, because the airfoil section 18 is curved, it is necessary to have some clearance between the edges 24 of the platform 22 and the airfoil section 18 so as to allow the platform 22 to move about the central axis of the rib 16. This clearance is of the order of 3 mm and is greatest at the axial ends of the platform 22. Air can thus circulate between the platform 22 and the blade 12, reducing the performance of the turbomachine.

The invention makes it possible to reduce the clearance between the edges 24 of the platform and the airfoil section 18 of the blade 12 by altering the dynamics involved in mounting the platforms on the ribs 16 of the disk 10 and by using protective liners to lock the platforms onto the disk.

In the prior art, liners were used to protect the blade roots 20 engaged in the cavities 14 from friction between these blade roots and the flanks of the cavities 14 of the disk. The interposition of an element such as a protective liner between the rib 16 and the blade root 20, the resistance to wear of which is lower than the wear resistance of the blade root 20 and of the disk 10, makes it possible to spare the blade root 20.

Figure 2:
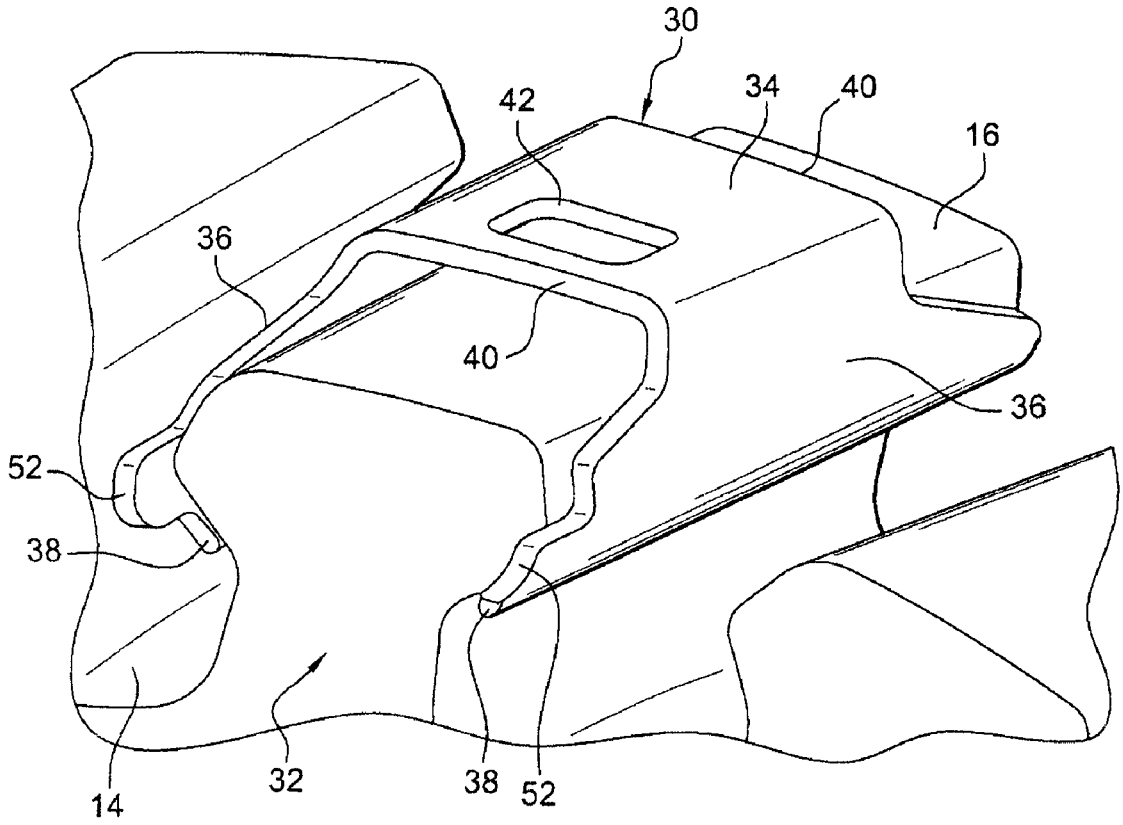
FIG. 2 is a schematic perspective view of a protective liner fitted onto a rib of the disk according to the invention.

FIG. 2 schematically depicts a protective liner 30 according to the invention, translationally engaged onto a rib 16 of a disk 32 according to the invention, just part of which is visible. The protective liner 30 has a C-shaped cross section allowing it to be engaged axially and retained radially on the rib 16. The central part 34 of the protective liner 30 extends over part of the rib 16 of the disk and is connected by substantially radial uprights 36 to the lateral edges 38 of the liner 30 and extends over the entire length of the disk 32. The lateral edges 38 positioned inside the cavity 14 bear against part of the rib and radially retain the protective liner 30. The central part 34 is substantially parallel to the peripheral external surface of the rib 16 of the disk 32 and cutouts 40 at its axial ends are substantially parallel to a plane perpendicular to the axis of the disk 32.

The protective liner 30 according to the invention not only prevents damage to the blade roots 20 but also holds the platform on the rib 16 of the disk 32 by forming means of locking the platform in position. To do that, the central part 34 of the liner 30 comprises an opening 42 and cutouts 40 at its axial ends.

Figure 3:
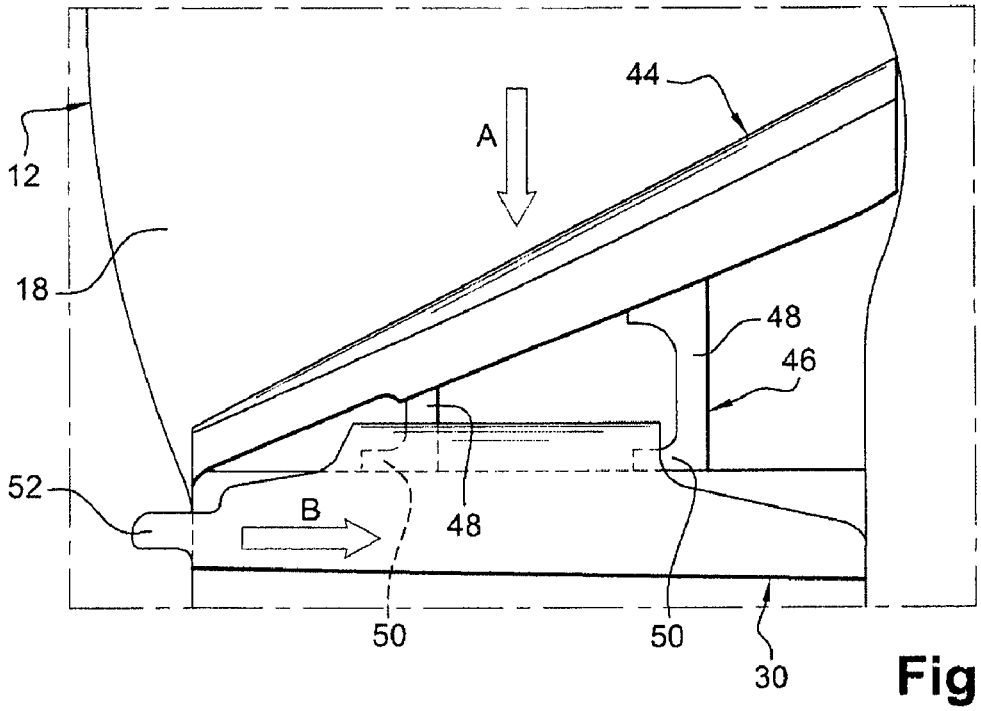
FIG. 3 is a schematic side view of an inter-blade platform according to the invention locked onto a rib of the disk.

FIG. 3 depicts a platform 44 according to the invention comprising roots 46 extending radially inwards, which roots are formed of radial uprights 48 and axial rims 50.

A platform 44 positioned on a rib 16 of the disk 32 is locked in place by translationally inserting the protective liner 30 onto a rib 16 of the disk 32. The liner 30 is moved along the rib 16 of the disk 32 as far as a position such that the roots 46 of the platform 44 can be inserted by a radial translational movement in the direction of the arrow A, into a cutout 40 and the opening 42 in the protective liner 30. The platform 44 depicted in FIG. 3 comprises two roots 46 which are axially offset and which after insertion through the protective liner 30 rest on the rib 16 of the disk 32. The protective liner 30 is then given a translational movement in the direction of the arrow B on the rib 16 so that the axial rims 50 are radially retained by the central part 34 of the protective liner 30, thus radially locking the platform 44 onto the disk 32. Indeed, in operation, the platform 44 is subjected to the effect of centrifugal force and suffers a radial displacement halted by the axial rims 50 which butt against the central part 34 of the protective liner.

Inserting the platform 44 radially means that the curvature of the edges of the platform 44 can coincide perfectly with the curvature of the airfoil section 18 and that the clearance between the platform 44 and the blade 12 is thus smaller.

In the embodiment of the protective liner 30 depicted in the drawings, the lateral upstream ends of the liner 30 form projections 52 with respect to the upstream face of the disk 32 when the liner 30 is in the position that locks the platform 44. These projections 52 are intended to collaborate with an annular component, not depicted, mounted on the upstream face of the disk 32 for axial retention of the blade roots 20 and of the protective liners 30.

Figure 4:
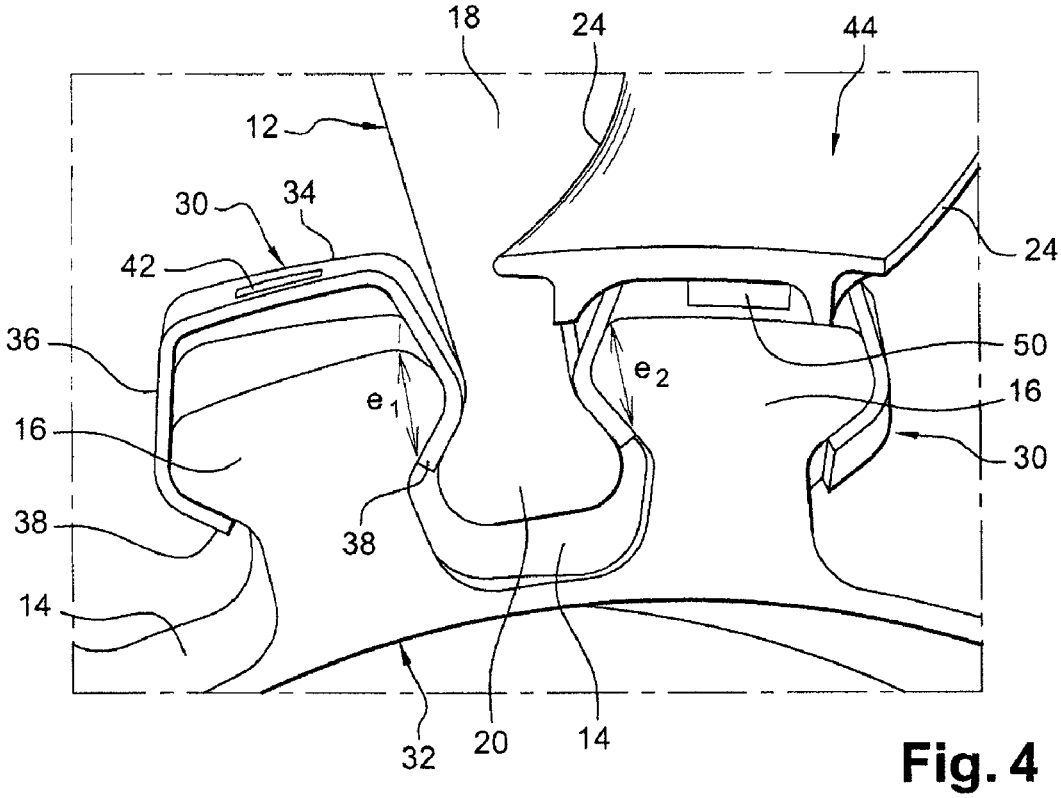
FIG. 4 is a schematic view from the left of the disk of FIG. 3.

In a preferred embodiment of the invention depicted in FIG. 4, the cavities 14 and the ribs 16 together with the protective liners 30 have a helicoidal profile. This profile makes it possible, when the cavities 14 are at an angle to the axis of the disk 32, to keep a constant thickness e1 over the entire length of the disk 32, this thickness also being substantially equal to the thickness e2 because the cavities 14 and ribs 16 follow the cylindrical profile of the disk 32. This type of profile thus makes it possible to reduce the wear on the blade roots 20.

Should a blade be lost, the protective liner 30 may also act as a limit stop or alternatively may deform to prevent contact between the platform 44 and the loose blade 12 as such contact may lead to ejection of the platform 44.

The protective liner 30 may have a variable number of cutouts 42 and openings according to the number of roots 46 that the platform 44 requires.

The protective liners are made of metal and have a thickness ranging between 0.1 and a few millimeters.

The invention claimed is:

1. A turbomachine fan rotor disk comprising, at its periphery:

blades having roots that are retained in cavities of the disk;

inter-blade platforms fixed to ribs delimited by the cavities in which the blade roots are mounted; and protective liners being mounted between flanks of the cavities of the disk and the blade roots, wherein the protective liners have a C-shaped cross section so that the liners can be fitted translationally and retained radially on the ribs of the disk and form means of locking the platforms onto a peripheral external surface of the ribs of the disk.

2. The disk as claimed in claim 1, wherein the platforms comprise roots pressed against the ribs of the disk, the roots of the platforms being engaged and retained in cutouts or openings in the liners.

3. The disk as claimed in claim 2, wherein the liners can be moved translationally on the ribs between a position in which the liners release the roots of the platforms and a position in which the liners retain the roots of the platforms.

4. The disk as claimed in claim 2, wherein the roots of the platforms comprise radial uprights and axial rims extending in an upstream direction from the radial uprights.

5. The disk as claimed in claim 2, wherein the liner includes a central part connected by substantially radial uprights to lateral edges and the cutouts or openings are provided in the central part.

6. The disk as claimed in claim 5, wherein the lateral edges of the liner extend over the entire axial length of the cavities of the disk.

7. The disk as claimed in claim 1, wherein the cavities and ribs of the disk and the protective liners have a helicoidal profile.

8. The disk as claimed in claim 1, wherein the platforms are mounted on the disk by radial translation.

9. A turbomachine including a fan rotor disk, the fan rotor disk comprising, at its periphery:

blades having roots that are retained in cavities of the disk;

inter-blade platforms fixed to ribs delimited by the cavities in which the blade roots are mounted; and protective liners being mounted between flanks of the cavities of the disk and the blade roots, wherein the protective liners have a C-shaped cross section so that the liners can be fitted translationally and retained radially on the ribs of the disk and form means of locking the platforms onto a peripheral external surface of the ribs of the disk.

10. The turbomachine as claimed in claim 9, wherein the turbomachine is provided in an airplane turbojet or a turboprop engine.

11. A protective liner for a blade root in a fan and which has a C-shaped cross section and comprises cutouts or openings which are formed in a central part connected by substantially radial uprights to lateral edges, the liner having a truncated helicoidal profile.

* * * * *